United States Patent [19]

Cohen

[11] 4,283,600

[45] Aug. 11, 1981

[54] RECIRCULATIONLESS CONCERT HALL SIMULATION AND ENHANCEMENT SYSTEM

[76] Inventor: Joel M. Cohen, P.O. Box 135, Brookline, Mass. 02146

[21] Appl. No.: 41,705

[22] Filed: May 23, 1979

[51] Int. Cl.[3] ..... H04R 3/00

[52] U.S. Cl. ..... 179/1 J

[58] Field of Search ..... 179/1 J, 1 G, 1 GP, 179/100.1 TD, 100.4 ST; 84/1.24, DIG. 26, 1.25

[56] References Cited

U.S. PATENT DOCUMENTS

| | | | |
|---|---|---|---|
| 3,145,265 | 8/1964 | Tamura et al. | 179/1 J |
| 4,039,755 | 8/1977 | Berkovitz | 179/1 J |

OTHER PUBLICATIONS

AUDIO, Leonard Feldman, "Time Delay for Ambience", Dec. 1976, pp. 40–50.

*Primary Examiner*—Joseph A. Popek

*Attorney, Agent, or Firm*—Weingarten, Maxham & Schurgin

[57] ABSTRACT

A recirculationless concert hall simulation and enhancement system includes a reproduction system having a primary loudspeaker driven from a signal source and a number of auxiliary loudspeakers driven by sequentially delayed replicas of the original signal so as to reproduce the ambience associated with large size concert halls in a considerably smaller listening room without tonal discoloration. In a preferred embodiment total cumulative sequential delays exceed 50 milliseconds to give enhanced ambience, while individual inter-speaker delays are limited to less than 50 milliseconds, so that distinguishable, distinct echoes are not generated.

3 Claims, 9 Drawing Figures

CONCERT HALL
(LONG DELAY TIME)

LISTENING ROOM
(SHORT DELAY TIME)

RECIRCULATIONLESS CONCERT HALL SIMULATION AND ENHANCEMENT SYSTEM

FIELD OF THE INVENTION

This invention relates to audio reproduction and more particularly to a recirculationless system which simulates large concert hall fidelity or ambience in a considerably smaller listening room or area.

BACKGROUND OF THE INVENTION

In the past, recreating concert hall performances in small listening areas has been accomplished through the use of reverberation generated by electronic recirculation of sound. This is a technique of simulating the ambient sound field made up of reflections of the original sound, with auxiliary loudspeakers used in conjunction with a primary loudspeaker. This simulates the "ambience" or "fullness" which occurs in a large concert hall. Reverberation techniques assume the original sounds to be pure and then add echo by electronic recirculation of the original sound. This produces a sound quality which approximates the concert as heard by a listener in a large concert hall.

However, due to the constant recirculation of the original signal with delays, phase cancellation in the audio signal can occur at various audio frequencies. This can give the listener the impression of booming or other resonances, which sound artificial and may detract from the enjoyment of the piece. Moreover, tonal coloration is changed by phase cancellation. This means that particular frequencies become much louder and others much softer in the auxiliary loudspeaker to which the recirculated signal is fed than they do in the primary loudspeaker. Normal listening is not disturbed by 3 dB of up and down frequency response, but long before the effect is noticeable, a situation may occur where at particular frequencies the auxiliary loudspeaker is ten times as loud as the primary loudspeaker. The result is that the auxiliary loudspeaker becomes a noticeable sound source. Moreover, as the reverberation time is increased by increasing any particular delay in the recirculation loop, a point is reached where a distinct echo is audible. This usually occurs when a delay of 50 milliseconds is reached.

To a lesser extent, phase cancellation also occurs in systems where the electronic signal is delayed and electronically summed prior to audio reproduction by one or more auxiliary loudspeakers. In such cases, the result sounds "tinny" or "twangy" when trying to create large concert hall ambience.

It is therefore desirable to eliminate phase cancellation in order to achieve a flat frequency response so that added sound gives the small listening room the appearance of being large without introducing extraneous effects. With a smooth or flat frequency response, the auxiliary loudspeakers are much less obvious as they create the large hall ambience.

By way of further background, reproducing the "ambience" of a large concert hall through the use of a "single" short delay on the order of 10 milliseconds is described in an article by E. Roerback Madsen entitled "Extraction of Ambiance Information from Ordinary Recordings," *Journal of the Audio Engineering Society,* October 1979, Vol. 18, No. 5, in which the Helmut Haas single delay system is described. In the Haas system, a primary speaker is fed directly from a signal source and an auxiliary loudspeaker is placed in the listening room spaced from the primary speaker. The auxiliary loudspeaker is driven by a replica of the original signal singly delayed by the aforementioned short time delay. The effect is adding "dimension" to the small listening room. Adding dimension refers to giving the small listening room the appearance of having longer dimensions than it actually has. The use of a single delay takes ambience in the original material and effectively distributes it around the small listening room to achieve a large concert hall sound. A certain "fullness" of sound is achieved by this technique. This "fullness" is not achievable by merely placing additional speakers around a listening room and driving them with undelayed signals.

In the system just described, for a single channel there is no attempt to enhance any acoustic effect, but merely to reproduce the original performance conditions. More fullness cannot be added by this system, and therefore, ambience enhancement does not occur with a single delay and a single auxiliary loudspeaker.

SUMMARY OF THE INVENTION

Accordingly, the subject invention includes the reproduction of ambience and enhancement through the use of a number of auxiliary loudspeakers, usually two, and sequentially delayed replicas of the original signal used to drive the primary speakers. This is a recirculationless delay system in which acoustic delay can be accumulated for enhancement purposes without any one delay exceeding that delay (50 milliseconds) at which echoes become noticeable. The sequential delays do not involve recirculation and this is scrupulously avoided. Moreover, electronic summing of sequentially delayed signals is avoided. Avoiding recirculation and electronic summing prevents phase cancellations and thus booming, tinniness and twangy reproduction, while still achieving enhanced ambience or fullness.

Although recirculation is not used in the subject system, it nonetheless reproduces the feeling of being in a large concert hall, all the more so because frequency distortions are not introduced.

In summary, the purpose of the subject system is to recreate and enhance the reflection continuum in a small listening area whose own reflections die out much quicker than the place to be simulated or recreated. To accomplish this, more than one delay is used to enhance the ambience of the source material as well as reproduce it properly in the listening room. Multiple sequential delays create a long total cumulative delay made up of sequential delays which in themselves are too short to create noticeable echoes. Once the total long delay is created, ambience is enhanced without echoes and without tonal discoloration due to phase cancellation.

The subject system is especially well adapted for use in cars, busses, vans or other vehicles in which the listening area is small. However, use is not limited to vehicles, but also applies equally well to home listening in which the listening room is considerably smaller than the concert hall in which the piece may have originally been performed.

BRIEF DESCRIPTION OF THE DRAWINGS

These and other advantages of the present invention are more fully set forth below in the accompanying detailed description and the accompanying drawing, of which.

DETAILED DESCRIPTION OF THE INVENTION

Figure 1:
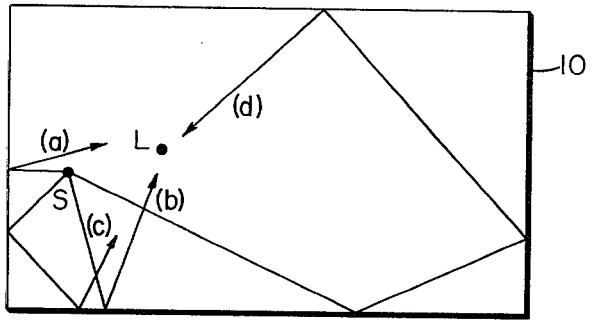
FIG. 1 is a diagrammatic representation of a large concert hall, indicating long decay times and a continuum of reflections which builds up almost immediately.

Referring to FIG. 1, a large concert hall is designated by reference character 10. In the concert hall is a source S and a listener designated by L. Sound from source S can reach the listener either directly or by virtue of reflection from the walls and the ceiling or floor of the concert hall. Sound reaching the listener directly from the source is that sound which is in general to be generated by a primary loudspeaker in a listening room, whereas ambience, which includes reflected sound is in general to be generated by an auxiliary loudspeaker in the listening room.

As can be seen from FIG. 1, the shortest reflection in the subject case would be from the back wall of the auditorium or concert hall, and this path is designated (a). The second shortest path illustrated in path (b), with path (c) and path (d) illustrating longer paths. As can be seen, the larger the concert hall, the longer the possible paths for reflected signals to traverse and therefore the longer the decay time in general of any acoustic signal generated within the concert hall. As will be appreciated, the decay time is proportional to room volume.

Reflections, however many there are, define a continuum, as opposed to being discernible as discrete reflections. This continuum builds up almost immediately, such that, as will be seen hereinafter, a high echo density is achieved. Achieving high echo density without recirculation from the subject system results in ambience reproduction and enhancement so as to give the aforementioned fullness to a small listening room area, and this is done without tonal discoloration.

Figure 2:
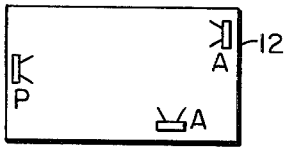
FIG. 2 is a diagrammatic representation of a typical small listening room with short decay times, indicating the placement of a primary loudspeaker and auxiliary loudspeakers.

A small listening room is diagrammatically illustrated in FIG. 2. Its dimensions may be in the range of 4 to 10 feet for the major dimension with an assumed maximum of 40 feet for home listening rooms. Within the listening room are located a primary speaker P and auxiliary speakers A, which are spaced from the primary loudspeaker. It is this system of primary and auxiliary loudspeakers which is utilized to create the ambience and enhancement described hereinafter.

Figure 3:
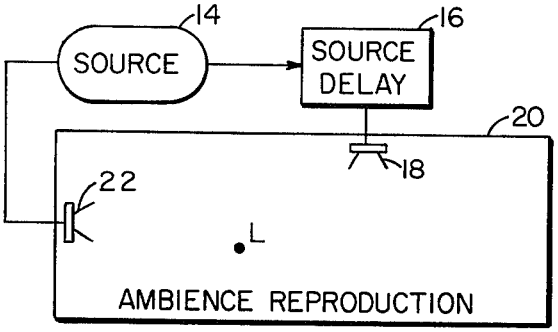
PRIOR ART FIG. 3
FIG. 3 is a diagrammatic illustration of an ambience reproduction system using a single short delay.

Referring to FIG. 3, as part of the prior art, ambience has been reproduced by the connecting of a sound source 14 to a single short delay circuit 16 which delays the signal therefrom on the order of 10 to 20 milliseconds. It should be noted that echoes become discernible at about a 50 millisecond delay. The output of the short delay circuit is coupled to a loudspeaker 18 within a listening room 20 and is spaced from a primary loudspeaker 22 connected directly to the source. Thus, ambience reproduction in the past has been accomplished by the placing of an auxiliary loudspeaker within the listening room and driving it with a signal which has been singly delayed.

It will be appreciated that in the system of FIG. 3, there is no enhancement of the ambience, but merely reproduction and distribution of the ambience in the work.

Figure 4:
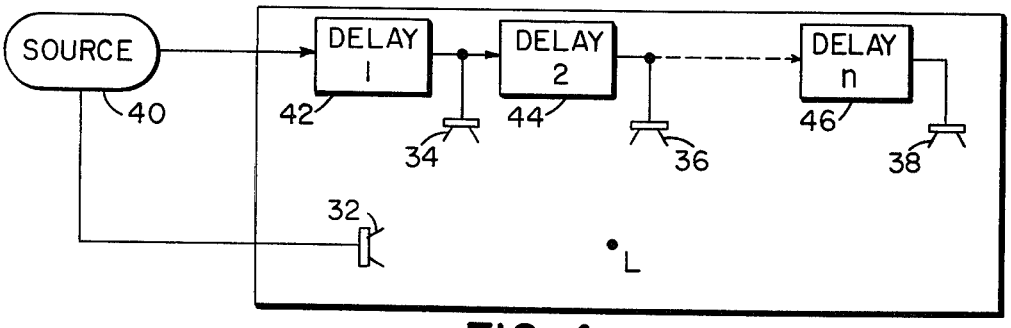
FIG. 4 is a schematic and block diagram of the subject system, illustrating sequential delays and loudspeakers driven by the delayed signals.

Enhancement is accomplished in the subject system, as illustrated in FIG. 4, by providing a listening room 30 with a primary loudspeaker 32 and a number of auxiliary loudspeakers 34, 36 and 38. It will be appreciated that any number of loudspeakers may be utilized as auxiliary speakers, the number conveniently being two for adequate ambience enhancement.

The primary loudspeaker is driven from a sound source 40 which also drives a number of serially connected delay lines 42, 44 and 46. Speaker 34 is driven by the output of delay line 42, with speakers 36 and 38 being driven respectively by the outputs of delay lines 44 and 46. In the system illustrated, signals from source 40 are sequentially delayed by a predetermined amount so as to achieve for the listener at L a feeling of expanded dimension of his listening room or area. With individual delays less than 50 milliseconds, which is equivalent to 55 feet, a certain fullness or ambience is experienced and enhanced with increasing numbers of sequential delays, with each delay limited to a maximum of 50 milliseconds. It will be appreciated that with this system delays totaling more than 50 milliseconds can be used for enhancement purposes without discernible echo problems. At 50 milliseconds, discernible echoes occur and this may or may not be a desirable condition, depending on the taste of the listener. This invention is not, however, limited by a 50 millisecond inter-speaker delay, although, for pure high fidelity, the inter-speaker delay should be maintained under the 50 millisecond mark.

Figure 5:
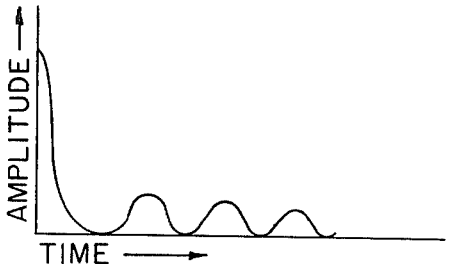
FIG. 5 is a diagram of the signals as heard by a listener in the listening room of FIG. 3, illustrating the effect of an impulse-type signal and the ambience signal created by the subject system.
Figure 6:
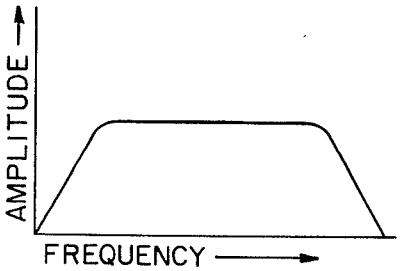
FIG. 6 is a frequency response curve for the ambience signals developed by two or more auxiliary loudspeakers as a result of processing by the subject system.

The resulting signal at the listener L is illustrated in FIG. 5 for an impulse from source 40. As can be seen, delayed lesser signals occur at the delays indicated. What is perhaps more important with respect to the subject system is its flat response with respect to frequency, as illustrated in FIG. 6. This fact alone prevents the booming, tinniness and twanginess from occurring, while enhanced dimension or ambience can be achieved through the sequential delays and the use of more than one delay and more than one auxiliary loudspeaker.

Instead of the illusion of sitting on stage with the instruments, what has been achieved is the listener is now apparently placed in a listening room of expanded dimension so as to recreate the concert hall experience for the listener.

Figure 7:
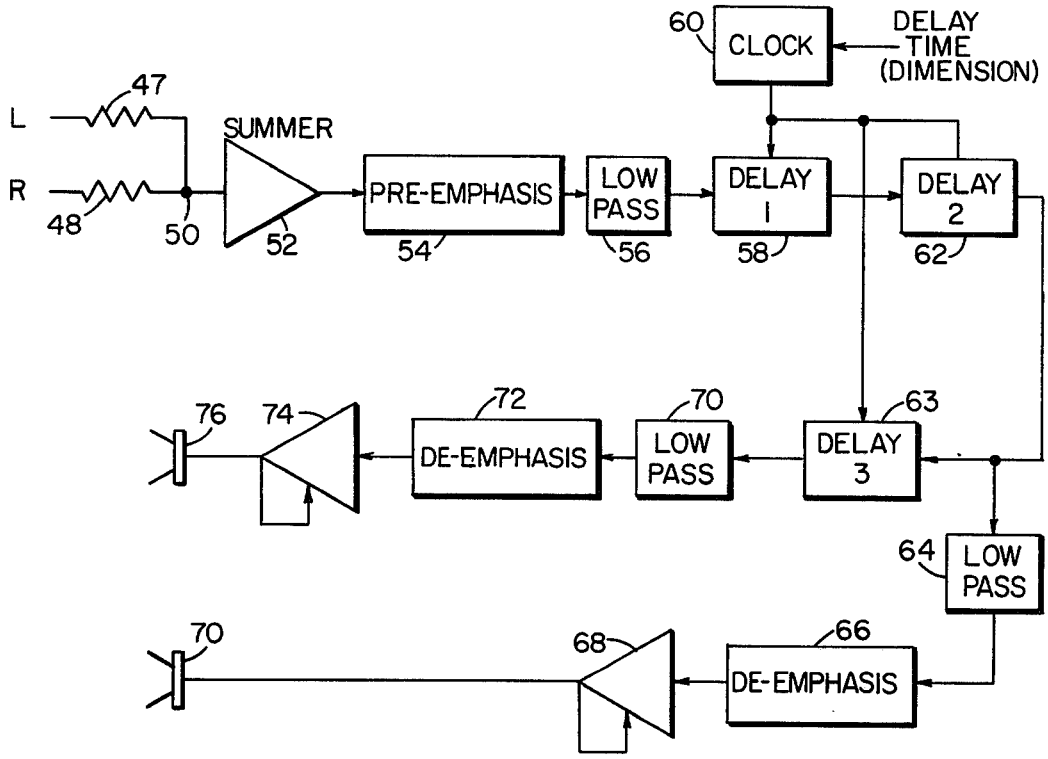
FIG. 7 is a schematic and block diagram of one embodiment of the subject invention.

Referring now to FIG. 7, in a typical stereo embodiment in which the outputs of a stereo receiver are used, left and right speaker channels may be summed at a point 50 having first passed through resistive elements 47 and 48, respectively. The output from point 50 is connected to a summing amplifier 52 which feeds a pre-emphasis circuit 54. Prior to describing the pre-emphasis circuit, it will be appreciated that monaural signals may be applied directly to the pre-emphasis circuit. Alternatively, the left channel and right channel from the stereo unit may have the ambience of the channel enhanced separately by sequential delays and plural auxiliary speakers. However, it is not necessary to obtain the ambience and enhancement of the subject invention by separately processing the left and right channels.

Referring to the pre-emphasis circuit 54, it is the purpose of this circuit to boost the relative amount of high frequencies in the signal and form the first part of a noise reduction system. This high frequency boost is later removed by de-emphasis circuits located in the drive circuits for the auxiliary loudspeakers.

In one embodiment, the pre-emphasis circuit increases the amplitude of signals above 1,000 Hz by 10 dB over signals having frequencies below 1,000 Hz. This is accomplished by a single pole, high-pass filter in parallel with a fixed gain amplifier, with the de-emphasis circuit decreasing the amplitude of signals above 1,000 Hz by 10 dB. While the technique of pre-emphasis and de-emphasis has been utilized in the past for hiss reduction, the 10 dB increases and decreases are exceptionally useful in eliminating hiss and noise in the subject system.

The signal from de-emphasis circuit 54 is applied to a low-pass filter 56 having a low-pass cut-off on the order of 6 kHz. The purpose of the low-pass filter is to filter out high frequencies that might mix with the clock pulses generated to control the delay circuits to be described, thereby creating audible distortion.

The output of the low-pass filter 56 is applied to a first delay unit 58 which may be a serial analog delay type shift register such as Model SAD1024 manufactured by the Reticon Corporation. This device is basically a bucket brigade device in which the delay is set by the clock rate at which the analog shift register is clocked. This is accomplished in one embodiment by a clock 60 which has a variable clock rate between 30 kHz and 150 kHz. The delay time, which corresponds to "dimension", is 5 milliseconds per delay circuit at the 150 kHz clock rate, and 25 milliseconds per circuit at the 30 kHz clock rate, the delay being variable therebetween.

The output of analog delay 58 is applied to a similar second delay circuit 62 which is clocked in parallel with delay circuit 58. The total delay attainable is therefore from 10 milliseconds to 50 milliseconds. Two delay circuits are not necessary to achieve the 50 millisecond delay and are used as a matter of convenience in view of the availability of the SAD1024 devices.

The output of delay circuit 62 is applied to a third delay circuit 63 which is also connected to clock 60 and is clocked thereby.

The output of delay circuit 62 is also applied through a low-pass filter 64 set at 6 kHz to remove clock noise and to de-emphasis circuit 66, which removes the high frequency boost of the pre-emphasis circuit. The output of de-emphasis circuit 66 is applied to a variable gain amplifier 68 and thence to a loudspeaker 70 which in general is mounted in spaced relationship to the primary loudspeaker (not shown in this figure).

The output of delay unit 63 is applied through a low-pass filter 70 also set at 6 kHz to remove clock noise and to a similar de-emphasis circuit 72. The output of de-emphasis circuit 72 is applied through a variable gain amplifier 74 to a second auxiliary speaker 76.

The placement of speakers 70 and 76 is not critical in that the sound in the listening environment is to be filled in between the speakers and the primary speaker by reflections in the listening room. Thus, the speakers do not become visible in terms of being a separate sound source as the delays between them are kept less than 50 milliseconds. Thus, for example, a first delay for speaker 70 to which is added a second delay for speaker 76, does not give the feeling that it is heard first on one auxiliary speaker, and second on the second auxiliary speaker. In short, the sound mixes in the room quite well.

With respect to the pre-emphasis and de-emphasis circuits, the pre-emphasis circuit, described above, enhances high frequency contents and amplifies them, whereas a de-emphasis circuit removes the high frequency content. This diminishes such things as hiss or any hissing sounds which are created in the circuits between the pre-emphasis and de-emphasis circuits.

It will be appreciated by increasing the delay that the apparent effect is that the space for the listener appears to get larger. This is why the control for the clock is called the "dimension" control.

Variable gain amplifiers 68 and 74 are utilized for balancing the outputs of the auxiliary speakers with the output of the primary speaker. The level setting of the auxiliary speakers is usually one of personal preference.

In the system described, the delays for the first and second auxiliary speakers may be identical. However, this is not a limitation on the system, and different delay ratios may be achieved for second order effects. Moreover, the first delay need not be longer than the second delay. However, the longer the inter-speaker delays the more enhancement which will be achieved. In general it is usually sufficient to provide a maximum delay of 50 milliseconds between the primary loudspeaker and first auxiliary loudspeaker, followed by a maximum delay of 25 milliseconds between the first and second auxiliary loudspeakers.

Figure 8A:
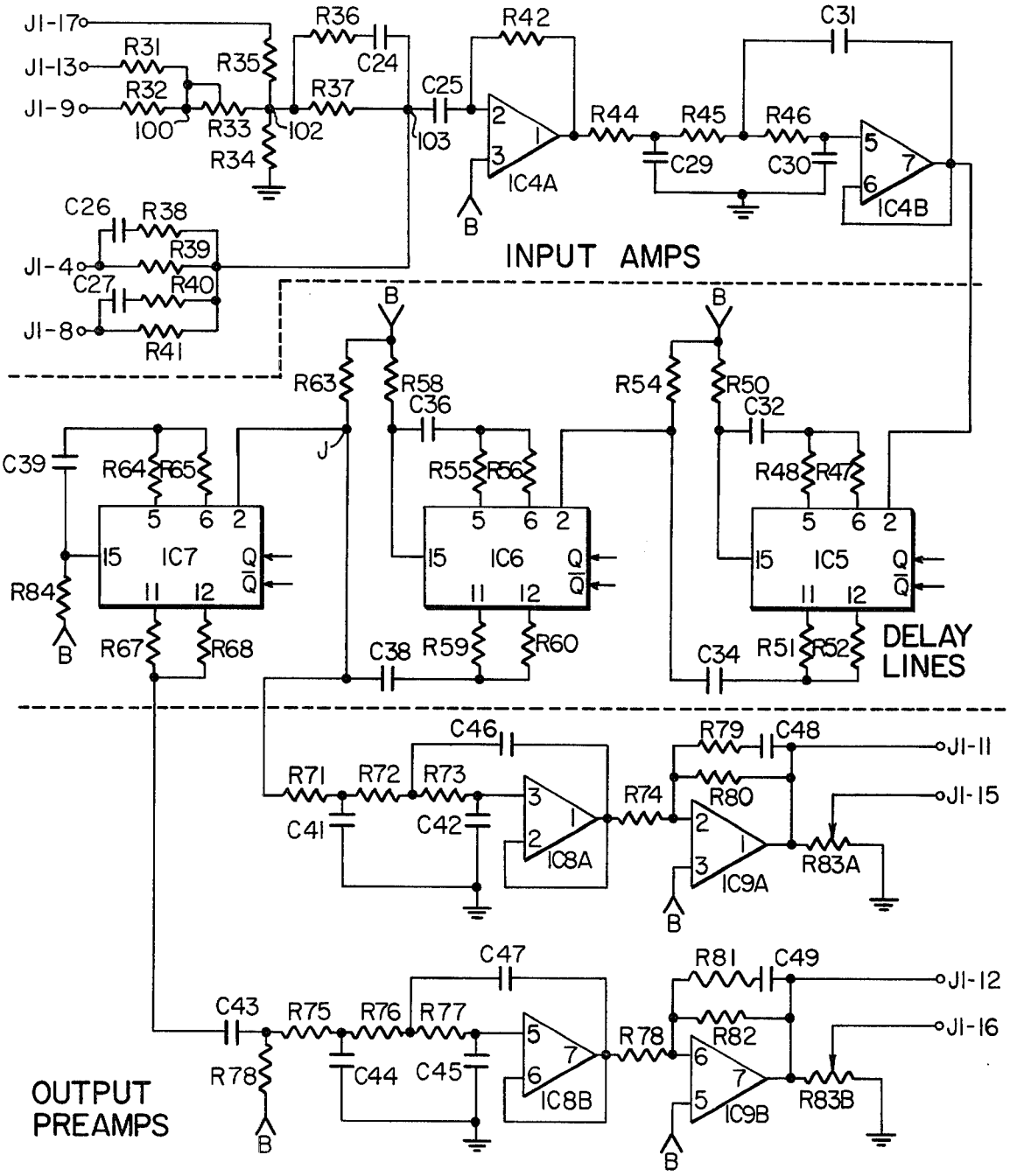
FIGS. 8A and 8B are detailed schematic diagrams of one implementation of the FIG. 7 embodiment.
Figure 8B:
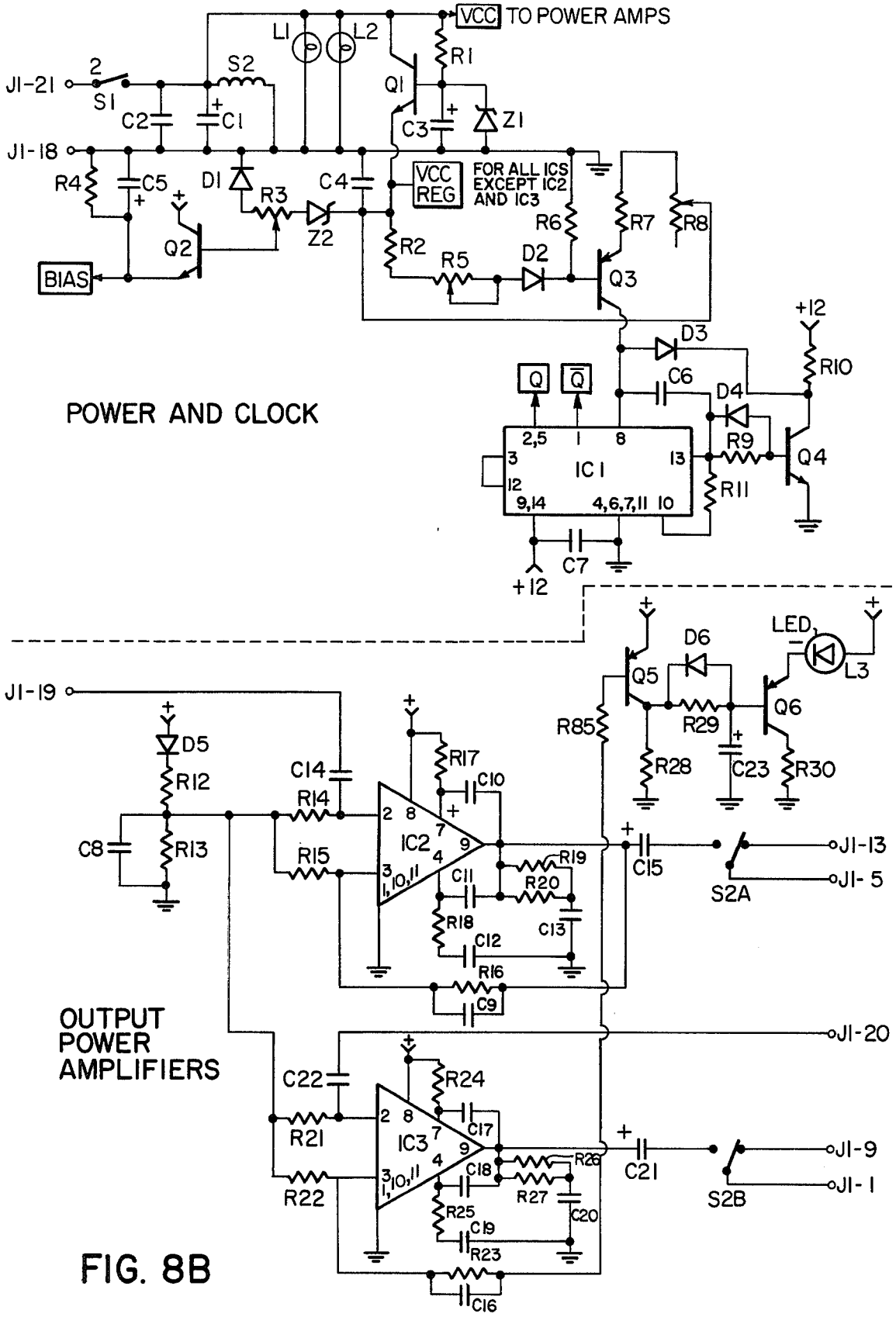

Referring to FIGS. 8A and 8B, a detailed schematic diagram of one embodiment of the subject invention is shown. Starting from the left-hand upper portion of the figure, the input signals are applied at three points J1–J7, J1–J13 and J1–9, respectively, through resistors R31, R32 and R35, with R31 and R32 output terminals summed at the junction 100. A variable potentiometer is connected between junction 100 and junction 102 which sums the outputs from R35 and R33. Signals coming into R31 and R32 then have an input level adjustment achieved with R33 so that those terminals are compatible with higher level inputs than that coming through R35. In this embodiment, the primary inputs are at pins J1–13 and J1–9. They are adapted to be connected to stereo output terminals which carry speaker level signals in an automotive high fidelity system. Ordinarily, these signals are on the order of three volts RMS. In a case where a power booster amplifier is installed, these signals may be substantially higher, and R33 is used to reduce these signals back down to the appropriate level. The input at J1–17 is set up as a monaural signal channel input from a secondary sound source such as a monaural car radio or a cassette tape deck. R34, in conjunction with R33, makes up a voltage attenuator at junction 102. The output at that junction 102 is applied to an RC network made up of R36, R37 and C24 which is a pre-emphasis network. At higher frequencies, the impedance of C24 drops and R36 becomes a parallel path to R37, increasing the signal strength into junction 103. IC4A is a standard feedback amplifier with a feedback path through R42.

Also feeding into junction 103 are two inputs J1–4 and J7–8 feeding into their own pre-emphasis circuits made up of R38, R39 and C26, in the case of terminal J1-4 and R40, R41 and C27 in the case of J1-8. These inputs are lower level inputs compatible with one volt maximum signal levels that would be achieved from a pre-amp level output available from more sophisticated auto equipment. Altogether, there are five signals available to sum at the junction of 103.

Junction 103 is coupled through C25 to a type 1458 dual-compensated microcircuit amplifier IC4A. The output of IC4A goes into a three-pole, low-pass filter made up of R44, R45 and R46, along with C29, C30 and C31 connected about IC4B, the other amplifier in the same package. This is a three-pole, low-pass filter set at 6 kHz which serves the purpose of keeping higher frequencies out of the delay line where they might create a beat with the clock frequency in the subsequent circuitry.

The output of IC4B at pin 7, is coupled to the first delay circuit IC5, which may be an SAD-1024 n channel bucket brigade device. In this device there are two sections of 512 stages each. These stages are connected in series. The signal is applied to pin 2, which is the input for one section. The output for this section is at pins 5 and 6. These are balanced outputs which are coupled into a summing network made up of R47 and R48. The signal from this summing network then passes through to C32 which sums with a resistor R50, to bring a bias voltage to the input of the next section which is at pin 15. The output of this section is available at pins 11 and 12 and functions the same way as the previously described circuit using R51 and R52 as a summing network. The output from this section is applied through C34 to the next delay chip IC6, again at pin 2, with R54 being utilized to bring the bias in. The serial delay process continues through the second delay chip, IC6 and on through the third chip IC7.

Note, identical circuitry is used with all serial analog delay units and is not described further.

The summed output of the last delay IC7 which occurs at the junction of R67 and R68, feeds another 6 kHz low-pass filter after passing through C43 which blocks the DC voltage at that summing point. The low-pass filter is made up of R75, R76, R77, C44, C45, C47 and IC8B, which functions identically to the filter described surrounding IC4B. The output of this low-pass filter feeds through R78 into the summing point of IC9B. A network in the feedback loop made up of R81, R82 and C49 is a de-emphasis circuit which is a mirror of the pre-emphasis circuit surrounding IC4A to flatten the frequency response back out. By reducing the high frequency gain, it both levels the high frequency response and also brings down the hiss portion of the noise generated through the delay circuitry.

The output of IC9B at J1-16 feeds a volume control R83B, the center arm of which is normally connected to the input J1-19 of a power amplifier stage (FIG. 8B) through capacitor C14.

Referring back to FIG. 8A, it will be appreciated that the circuit fed from point J is an identical de-emphasis circuit. This circuit feeds a low-pass filter surrounding IC8A identical to the circuit surrounding IC8B. Thereafter, a de-emphasis circuit IC9A similar to IC9B already described is employed.

Referring now to FIG. 8B, the outputs of pre-amplifier circuits IC9A and B are fed to power amplifier circuits, one of which is shown as IC2 and surrounding components. IC2 is a monolithic power amplifier which is available as Model ESM 732 of Nucleonic Products Co. The input signal for this power amplifier is applied through a DC voltage blocking capacitor C14 to pin 2 of the power amplifier. Pins 2 and 3 are differential inputs to the amplifier and receive a bias voltage through R14 and R15, respectively, which is generated by the network of D5, R12, R13 and C8. This bias is fed to both high power amplifiers IC2 and IC3. The output of amplifier IC2 is at pin 9. The feedback loop which sets the gain of the amplifier goes from pin 9 to pin 3 via R16 which sets the gain and C9 to keep IC2 from oscillating. Networks made up of R17, R18, R19, R20 and C10, C11, C12 and C13 are specified by the manufacturer of the amplifier as being necessary to subdue oscillations that might occur with a power amplifier.

The output of the power amplifier feeds a positive terminal of C15 which is a large capacitor to block DC from the loudspeaker. The loudspeaker is attached after relay contacts labeled S2A. The purpose of the relay is to connect the speakers to the signal source that feeds the subject unit when the power is turned off to it so that the ambient speakers are connected to the direct sound speakers to recreate a four-speaker stereo system, when the subject unit is off.

The second delayed signal from J1-15 (FIG. 8A) is applied to J1-20 (FIG. 8B) for power amplifier IC3.

With respect to the second power amplifier, a circuit may be provided which detects when the voltage swing of the amplifier has reached the supply voltage and therefore clipping is indicated. It consists of an amplifier made up of Q5 with R85 and R28, a rectifier storage capacitor circuit made up of D6, D29 and C23 which stretches the duration of the indication, an LED driving amplifier made up of Q6 and R30 and an LED, L3. The LED lights to indicate that clipping has occurred.

What is now described is the power and clocking circuit. It will be appreciated that the clocking circuit produces clock pulses which are applied to the serial analog delay lines to control the amount of delay in the delay lines.

Power is applied to the unit through a power switch S1 onto filter capacitors C1 and C2 which are provided to keep noise that might be on the automotive supply line out of the unit. A coil S2 for the aforementioned relay is provided between S1 and ground so that when the switch is closed, the relay pulls in and connects the secondary loudspeakers to the subject unit. Two pilot lamps L1 and L2 are also across this line. A voltage regulator made up of R1, Zener diode Z1, and filter capacitor C3 feeding Q1 provides a regulated voltage at R2 to feed the low level circuitry so that variations in the automobile battery voltage will not affect the performance of that circuitry.

Networks made up of Z2, R3, D1, Q2 feeding R4, and filter capacitor C5 provide a bias voltage B which can be adjusted with R3 to supply the proper bias for the analog delay circuits so as to minimize distortion of the signal passing through them.

As for setting "dimension" by setting clock timing, R5, D2 and R6 form a variable voltage divider driving the base of Q3 to set via R5 a voltage in the base of Q3 which determines the maximum delay time which will be controlled by variable resistor R8 in series with fixed resistor R7. The collector of Q3 feeds pin 8 of a dual flipflop IC1 which is the clock generating circuit. IC1 is available as Model CD4013 from RCA. That circuit, in conjunction with a feedback circuit made up of C6, R11, R9, D3, D4, R10, Q4 form a bistable multivibrator to generate the synchronous clock pulses in two phases at the Q and Q outputs 2, 5 and 1 of IC1. Those connect to the appropriate terminals (not shown) of IC5, 6 and 7 of FIG. 8A.

What has therefore been provided is a unit for adding ambience without recirculation circuitry. It should be noted that the preferred embodiment described herein is not to be construed as a limitation upon the invention, and the present invention is only to be limited as indicated by the appended claims.

What is claimed is:

1. A recirculationless ambience enhancement system which does not create booming or introduce tonal discoloration for use with a signal source, a primary loudspeaker connected to the source and located in a listening area, and a plurality of auxiliary loudspeakers spaced from said primary loudspeaker within the listening area comprising:

means for sequentially delaying signals from said source without recirculation so as to produce a corresponding number of delayed signals, the delay periods being less than that at which echoes are ascertainable, the cumulative delay periods exceeding that at which echoes are ascertainable; and, means for driving said auxiliary loudspeakers respectively only with said sequentially delayed signals, such that ambience is enhanced over that of the original signal source without echo-related phase cancellations which would cause divergence from a flat frequency response.

2. The system of claim 1 wherein said delay means includes serial analog delay units, clock means for clocking said delay units, and means for altering the clock repetition rate so as to alter the delay, thereby to alter the dimension simulated by the ambience enhancement system.

3. A method of enhancing original concert hall ambience in a small listening area without creating ascertainable echoes, without signal recirculation and without creating booming or introducing tonal discoloration comprising the steps of:

acoustically reproducing at one location in the listening area sound from an original sound source; and acoustically reproducing without recirculation at a plurality of locations in the listening area sound from the original source, all of which is sequentially delayed such that distinct echoes are not discernible; such that the cumulative delay exceeds that at which echoes are discernible; and such that phase cancellations are avoided.

* * * * *

UNITED STATES PATENT AND TRADEMARK OFFICE

CERTIFICATE OF CORRECTION

PATENT NO. : 4,283,600

DATED : August 11, 1980

INVENTOR(S) : Joel M. Cohen

It is certified that error appears in the above—identified patent and that said Letters Patent is hereby corrected as shown below:

Column 2, line 57, "busses" should read --buses--.

Column 3, line 2, "decay times" should read --delay times--;

line 5, "decay times" should read --delay times--;

line 45, "decay time" should read --delay time--;

line 47, "decay time" should read --delay time--.

Column 9, line 1, "at the Q and Q" should read --at the Q and $\overline{Q}$--.

Signed and Sealed this

Tenth Day of November 1981

[SEAL]

*Attest:*

GERALD J. MOSSINGHOFF

*Attesting Officer*

*Commissioner of Patents and Trademarks*